US008789467B2

(12) United States Patent
Crawford

(10) Patent No.: US 8,789,467 B2
(45) Date of Patent: Jul. 29, 2014

(54) SURFACE SAFE EXPLOSIVE TOOL

(71) Applicant: Halliburton Energy Service, Inc., Houston, TX (US)

(72) Inventor: Donald L. Crawford, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/847,485

(22) Filed: Mar. 20, 2013

(65) Prior Publication Data

US 2013/0277109 A1 Oct. 24, 2013

Related U.S. Application Data

(60) Continuation of application No. 13/236,174, filed on Sep. 19, 2011, now Pat. No. 8,424,455, which is a division of application No. 12/172,044, filed on Jul. 11, 2008, now Pat. No. 8,113,119.

(51) Int. Cl.

| | |
|---|---|
| ***F42C 15/34*** | (2006.01) |
| ***E21B 43/116*** | (2006.01) |
| ***E21B 43/1185*** | (2006.01) |
| ***F42D 5/00*** | (2006.01) |
| ***F42C 15/36*** | (2006.01) |
| ***F42D 1/04*** | (2006.01) |
| ***F42C 15/32*** | (2006.01) |
| ***E21B 43/119*** | (2006.01) |

(52) U.S. Cl.

CPC . *F42D 1/04* (2013.01); *F42C 15/36* (2013.01); *F42C 15/32* (2013.01); *E21B 43/119* (2013.01); *E21B 43/116* (2013.01); *F42C 15/34* (2013.01); *F42D 5/00* (2013.01)

USPC ..... 102/224; 102/222; 102/229; 102/313; 102/322; 175/4.54; 166/55; 166/63

(58) Field of Classification Search

USPC ..... 102/202.1, 206, 221, 222, 223, 224, 102/225, 226, 228, 229, 310, 313, 314, 319, 102/321, 322, 331; 89/1.15, 1.151; 166/55.1, 55, 297, 299, 63; 175/4.54, 175/4.55, 4.56, 4.52

See application file for complete search history.

(56) References Cited

U.S. PATENT DOCUMENTS

| | | | |
|---|---|---|---|
| 4,306,628 | A | 12/1981 | Adams, Jr. et al. |
| 4,872,507 | A | 10/1989 | Ronco, Sr. et al. |

(Continued)

OTHER PUBLICATIONS

Office Action dated Sep. 23, 2010, U.S. Appl. No. 12/172,044, filed Jul. 11, 2008.

(Continued)

*Primary Examiner* — James Bergin

(57) ABSTRACT

An explosive tool comprises a body structure, a charge, a detonator to ignite the charge via propagation of thermal energy, a pressure actuated safety to prevent propagation of sufficient thermal energy to ignite the charge when the pressure actuated safety is subjected to a surface pressure and to not prevent propagation of sufficient thermal energy to ignite the charge when the pressure actuated safety is subjected to at least a predefined pressure threshold, and a temperature actuated safety to prevent propagation of sufficient thermal energy to ignite the charge when the temperature actuated safety is subjected to a surface temperature and to not prevent propagation of sufficient thermal energy to ignite the charge when the temperature actuated safety is subjected to at least a predefined temperature threshold. The charge, the detonator, the pressure actuated safety, and the temperature actuated safety are contained within the body structure.

20 Claims, 8 Drawing Sheets

(56) References Cited

U.S. PATENT DOCUMENTS

| | | | | |
|---|---|---|---|---|
| 5,165,489 | A | 11/1992 | Langston | |
| 5,223,665 | A * | 6/1993 | Burleson et al. | 102/312 |
| 5,237,136 | A | 8/1993 | Langston | |
| 5,322,019 | A | 6/1994 | Hyland | |
| 5,346,014 | A | 9/1994 | Ross | |
| 5,369,579 | A | 11/1994 | Anderson | |
| 5,456,316 | A * | 10/1995 | Owens et al. | 166/250.01 |
| 5,490,563 | A | 2/1996 | Wesson et al. | |
| 5,811,894 | A | 9/1998 | Buyers et al. | |
| 6,779,605 | B2 | 8/2004 | Jackson | |
| 7,878,242 | B2 | 2/2011 | Gray | |
| 8,113,119 | B2 | 2/2012 | Crawford | |
| 8,424,455 | B2 | 4/2013 | Crawford, II | |
| 2007/0007016 | A1 * | 1/2007 | Sanderlin | 166/381 |
| 2008/0134922 | A1 | 6/2008 | Grattan et al. | |

OTHER PUBLICATIONS

Office Action Restriction/Election dated Mar. 16, 2011, U.S. Appl. No. 12/172,044, filed Jul. 11, 2008.

Notice of Allowance dated Jun. 24, 2011, U.S. Appl. No. 12/172,044, filed Jul. 11, 2008.

Notice of Allowance dated Oct. 7, 2011, U.S. Appl. No. 12/172,044, filed Jul. 11, 2008.

Office Action Restriction/Election dated Apr. 26, 2012, U.S. Appl. No. 13/236,174, filed Sep. 9, 2011.

Office Action dated Jun. 25, 2012, U.S. Appl. No. 13/236,174, filed Sep. 19, 2011.

Notice of Allowance dated Dec. 31, 2012, U.S. Appl. No. 13/236,174, filed Sep. 19, 2011.

* cited by examiner

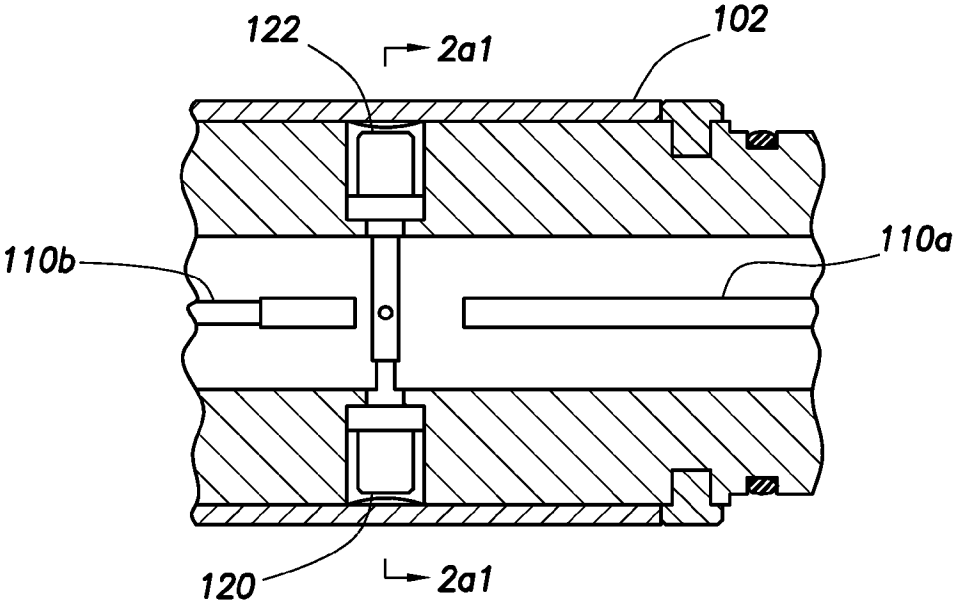
FIG.2a
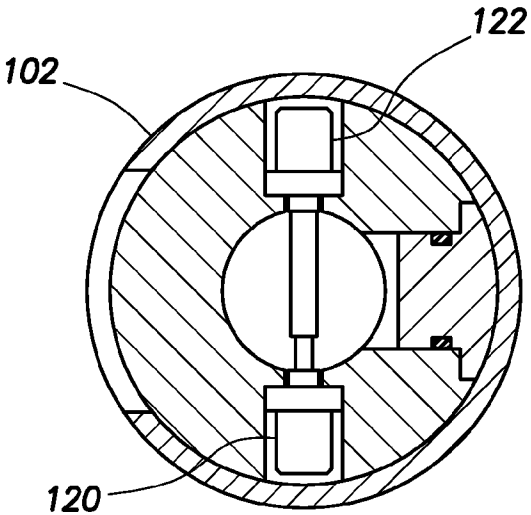
FIG.2a1

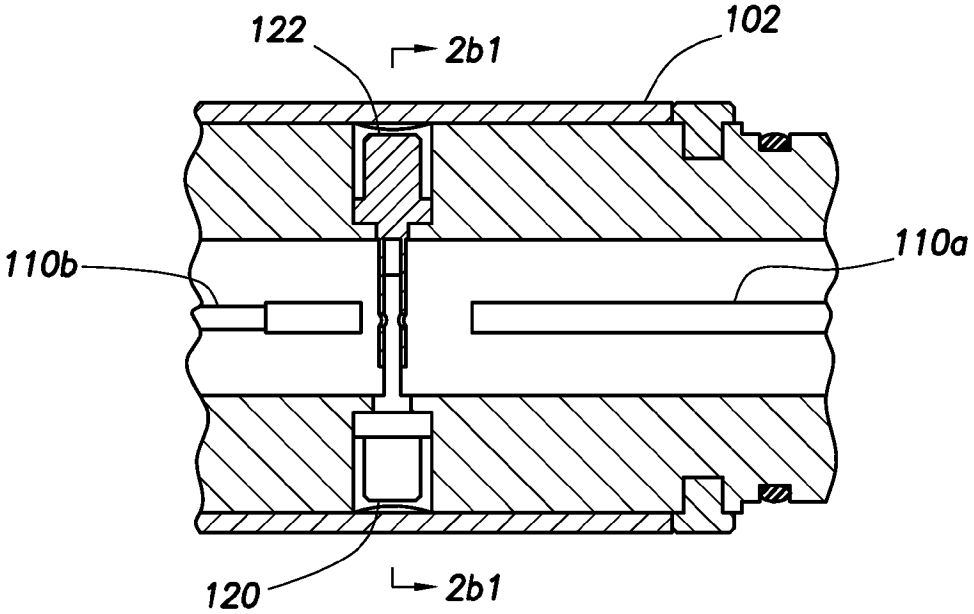
FIG.2b
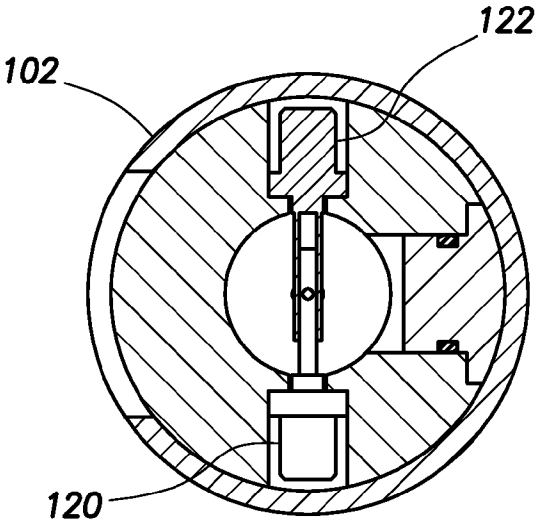
FIG.2b1

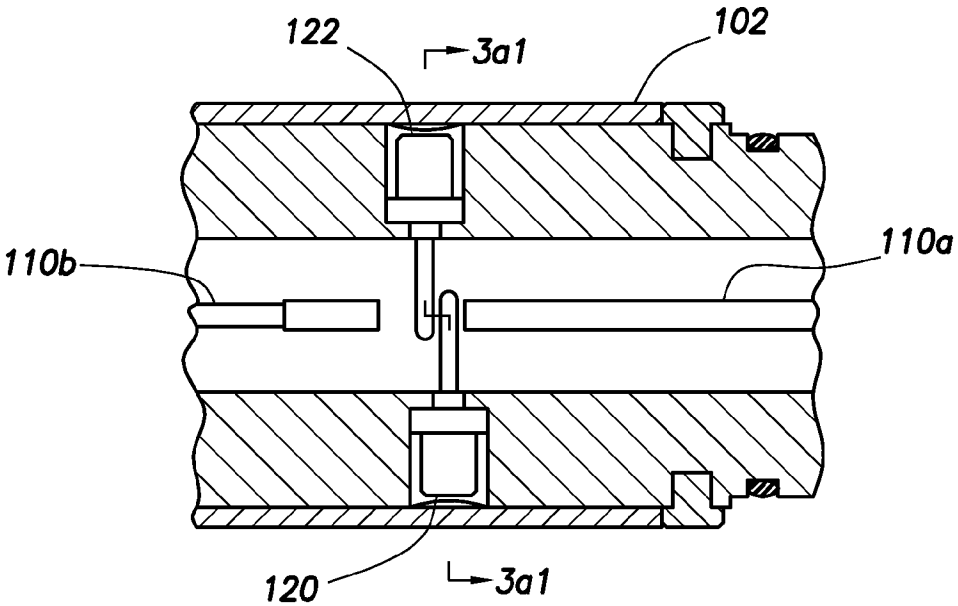
FIG.3a
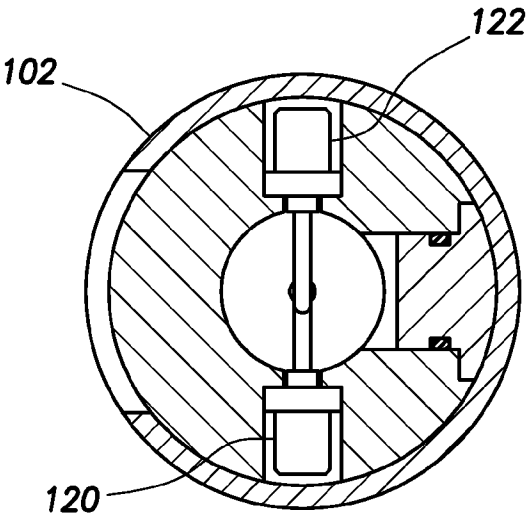
FIG.3a1

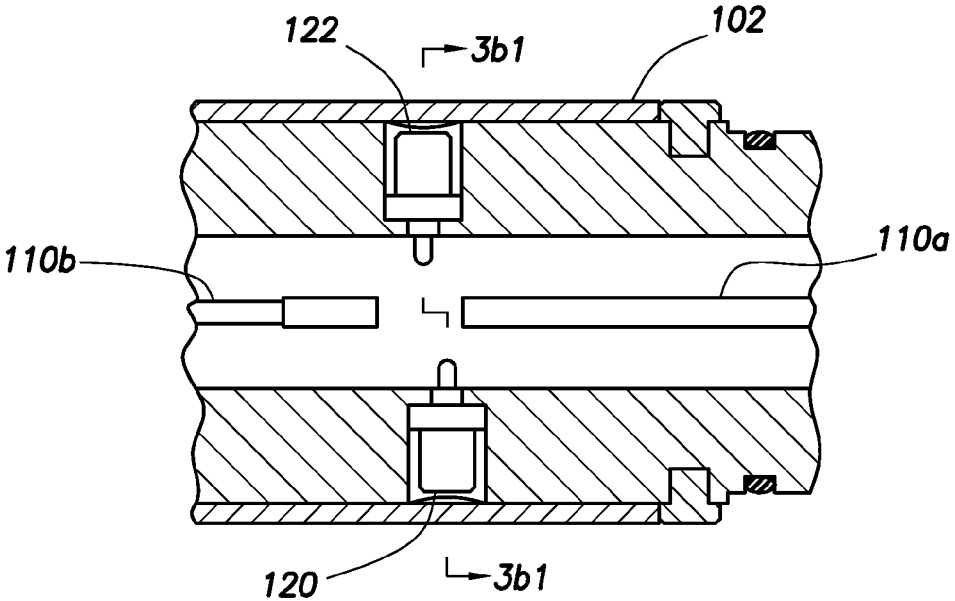
FIG.3b
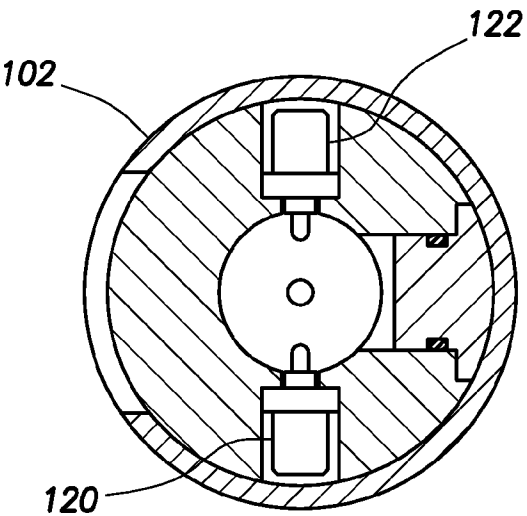
FIG.3b1

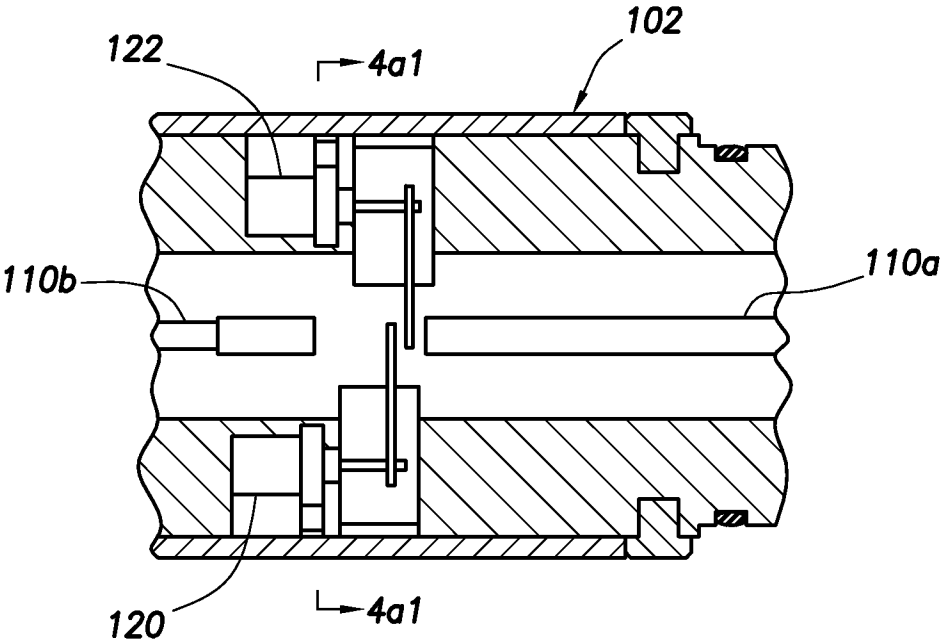
FIG. 4a
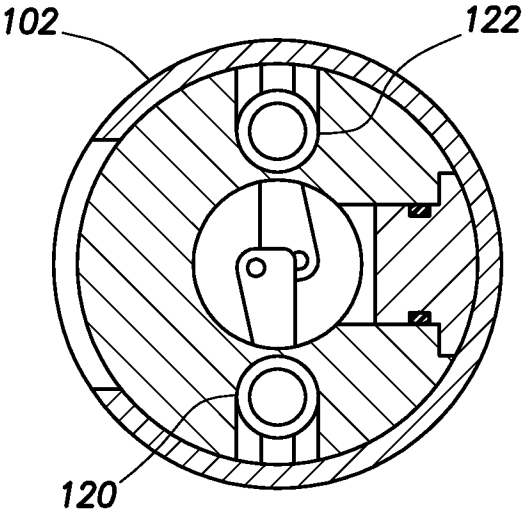
FIG. 4a1

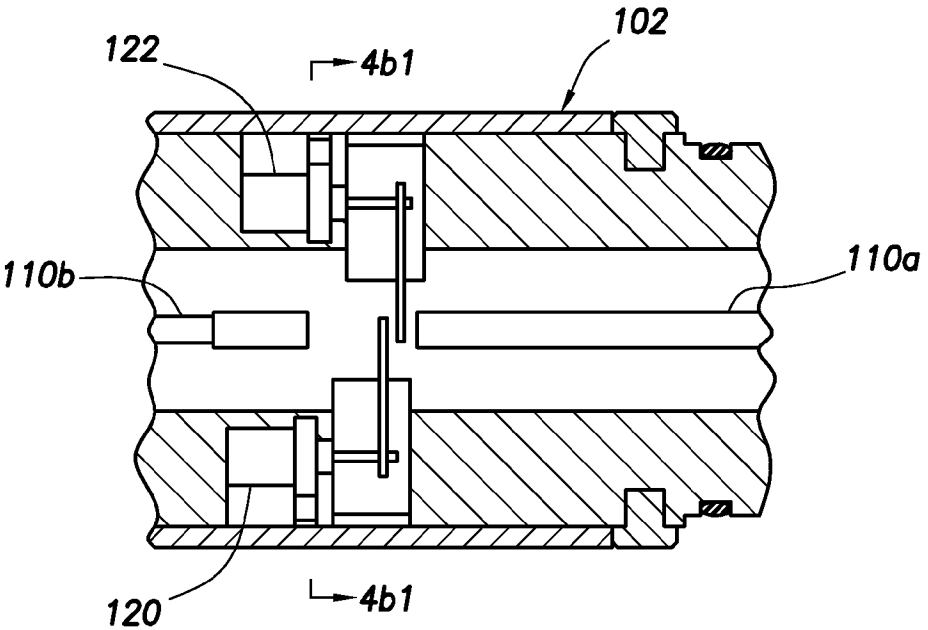
FIG. 4b
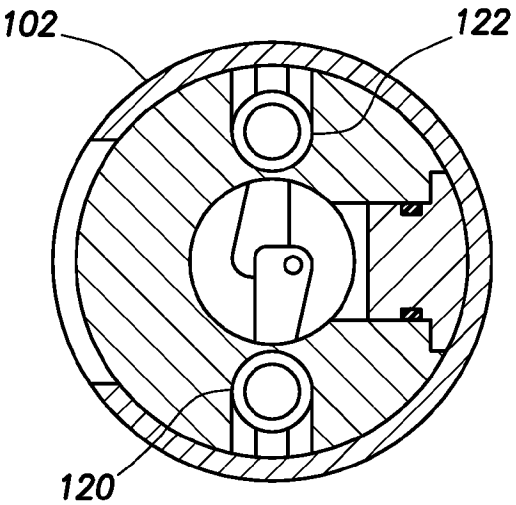
FIG. 4b1

SURFACE SAFE EXPLOSIVE TOOL

CROSS-REFERENCE TO RELATED APPLICATIONS

This application is a continuation of and claims priority under 35 U.S.C. §120 to U.S. patent application Ser. No. 13/236,174, filed on Sep. 19, 2011 now U.S. Pat. No. 8,424,455, entitled "Surface Safe Explosive Tool," by Donald L. Crawford II, which is a divisional of U.S. patent application Ser. No. 12/172,044, filed on Jul. 11, 2008 now U.S. Pat. No. 8,113,119, entitled "Surface Safe Explosive Tool," by Donald L. Crawford II, both of which are incorporated herein by reference in their entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Downhole oilfield tools may be called upon to operate reliably and safely in a hostile environment. The downhole oilfield tools may operate under high pressure associated with a passive hydraulic pressure created by a several thousand foot column of drilling fluid in the wellbore. Temperature extremes can be encountered in different wellbores in different regions around the world. Sometimes the downhole oilfield tools may be called upon to operate in the presence of caustic chemicals that may have been introduced into the wellbore to encourage or stimulate production of hydrocarbons in well completion operations. The downhole oilfield tools may be installed onto a work string for deployment into the wellbore by marginally skilled and sometimes fatigued workers. Furthermore, the working environment at the surface of a wellbore may be dirty, cluttered, and unsuited to delicate, precise, and clean final assembly of precision and/or finicky downhole oilfield tools.

Some wellbores are cased by placing a string of casing pipe extending from the surface to a location near the bottom of the wellbore. A perforation gun is a type of downhole explosive tool that is directed to cutting orifices in the casing and further to cut some distance into the formation surrounding the wellbore to form channels by the use of an explosive charge. The hydrocarbons and/or other fluids trapped in the formation flow into the channels introduced into the formation by firing the perforation gun, into the casing through the orifices cut in the casing, and up the casing to the surface for recovery. In some circumstances multiple perforation gun sub assemblies may be connected to each other and fired in unison.

Because of the danger associated with the powerful explosive charges contained in a fully assembled, armed explosive tool, great care must be taken to assure safety in operation and transportation of fully assembled explosive tools. A fully assembled explosive tool may be vulnerable to several accidental firing scenarios. For example, an electrically initiated explosive tool may be subject to accidental firing in response to electrostatic shocks, such as those associated with lightning or build up of electrostatic charges resulting from friction between moving objects, or Radio Frequency energy in the surrounding environment. Some explosive tools may be subject to accidental firing in response to excessive heat, such as may be experienced in a fire, for example a fire caused by a vehicle accident.

SUMMARY

In an embodiment, an explosive tool is provided. The explosive tool comprises a body structure, a charge, a detonator to ignite the charge via propagation of thermal energy, a pressure actuated safety to prevent propagation of sufficient thermal energy to ignite the charge when the pressure actuated safety is subjected to a surface pressure and to not prevent propagation of sufficient thermal energy to ignite the charge when the pressure actuated safety is subjected to at least a predefined pressure threshold, and a temperature actuated safety to prevent propagation of sufficient thermal energy to ignite the charge when the temperature actuated safety is subjected to a surface temperature and to not prevent propagation of sufficient thermal energy to ignite the charge when the temperature actuated safety is subjected to at least a predefined temperature threshold, wherein the charge, the detonator, the pressure actuated safety, and the temperature actuated safety are contained within the body structure. In another embodiment, the explosive tool may further include a chamber within the body structure containing the detonator; a chamber within the body structure containing the charge; and a port between the chamber within the body structure containing the detonator and the chamber within the body structure containing the charge and through which the thermal energy propagates. In another embodiment, the explosive tool may be a perforating gun. In another embodiment, the pressure actuated safety comprises a retractable shaft that is spring loaded to extend, preventing propagation of sufficient thermal energy to ignite the charge, when the pressure actuated safety is subjected to the surface pressure and to retract, to not prevent propagation of sufficient thermal energy to ignite the charge, when the pressure actuated safety is subjected to at least the predefined pressure threshold. In another embodiment, the temperature actuated safety comprises a rotatable sleeve containing a hole there through that is spring loaded to rotate in a first direction, preventing propagation of sufficient thermal energy to ignite the charge, when the temperature actuated safety is subjected to the surface temperature and to rotate in a direction opposite the first direction, to not prevent propagation of sufficient thermal energy to ignite the charge, when the temperature actuated safety is subjected to at least the predefined temperature threshold. In another embodiment, the retractable shaft of the pressure actuated safety is positioned within the rotatable sleeve of the temperature actuated safety at least when the retractable shaft is extended. In another embodiment, the temperature actuated safety comprises a wax thermostatic element that actuates the rotary movement of the temperature actuated safety in response to temperature. In another embodiment, the temperature actuated safety comprises a bimetallic thermostatic element that actuates the rotary movement of the temperature actuated safety in response to temperature. In another embodiment, the temperature actuated safety comprises a rotatable shaft coupled transversely to a substantially planar member having a hole there through, wherein when the temperature actuated safety is subjected to a surface temperature, the rotatable shaft rotates the planar member to offset the hole in the planar member to prevent propagation of sufficient thermal energy to ignite the charge and when the temperature actuated safety is subjected to the predefined downhole temperature, the rotatable shaft rotates the planar member to align the hole in the planar member to not prevent propagation of sufficient thermal energy to ignite the charge. In another embodiment, the temperature actuated safety comprises a retractable shaft that is spring loaded to extend, to prevent propagation of sufficient thermal energy to ignite the charge, when the temperature actuated safety is subjected to the surface temperature and to retract, to not prevent propagation of sufficient thermal energy to ignite the charge, when the temperature actuated safety is subjected to at least the predefined temperature threshold. In another embodiment, the temperature actuated safety is constructed with a keying feature that impedes installation of the temperature actuated safety into the body structure in an inoperable alignment. In another embodiment, the detonator is electrically activated.

In another embodiment, a method of assembling an explosive tool is disclosed. The method comprises installing a detonator inside a tool, wherein the explosive tool is configured for attaching to a work string, and installing a charge inside the explosive tool, wherein the detonator is operable to ignite the charge by thermal energy propagation between the detonator and the charge. The method also comprises installing a pressure actuated safety that is configured to prevent propagation of sufficient thermal energy between the detonator and the charge to ignite the charge when the pressure actuated safety is at surface pressure and to not prevent propagation of sufficient thermal energy between the detonator and the charge to ignite the charge when the pressure actuated safety is at at least a predefined pressure threshold. The method also comprises installing a temperature actuated safety that is configured to prevent propagation of sufficient thermal energy between the detonator and the charge to ignite the charge when the temperature actuated safety is at a surface temperature and to not prevent propagation of sufficient thermal energy between the detonator and the charge to ignite the charge when the temperature actuated safety is at at least a predefined temperature threshold. In another embodiment, installing the charge, installing the detonator, installing the pressure actuated safety, and installing the temperature actuated safety are performed before delivering the explosive tool to a field location. In another embodiment, the method further comprises transporting the explosive tool with the detonator, the charge, the pressure actuated safety, and the temperature actuated safety installed in the explosive tool over a public road to a field location. In another embodiment, the method further includes coupling the explosive tool to a work string, running the explosive tool coupled to the work string into a wellbore, withdrawing the explosive tool coupled to the work string out of the wellbore, wherein the detonator of the explosive tool remains in an unfired state, decoupling the explosive tool from the work string, and transporting the explosive tool over a public road away from the field location. In another embodiment, the method further comprises transporting the explosive tool with the detonator, the charge, the pressure actuated safety, and the temperature actuated safety installed in the explosive tool in part via an airborne vehicle to a field location. In another embodiment, the explosive tool is a perforating gun. In another embodiment, the explosive tool is a perforating gun downhole oilfield tool. In another embodiment, the detonator is installed in a first chamber of the explosive tool, the charge is installed in a second chamber of the explosive tool, and the detonator is operable to ignite the charge by thermal energy propagation through a port coupling the first chamber to the second chamber.

In yet another embodiment, a method of transporting an armed explosive tool is provided. The method comprises prior to transporting, assembling and arming an explosive tool comprising a detonator, an explosive charge, a pressure actuated safety, and a temperature actuated safety and transporting the armed explosive tool to a field location by at least one of transportation over a public road and transportation via airborne vehicle. In another embodiment, the method further comprise coupling the armed explosive tool to a work string, running the explosive tool coupled to the work string into a wellbore, withdrawing the explosive tool coupled to the work string out of the wellbore, wherein the detonator of the explosive tool remains in an unfired state, decoupling the explosive tool from the work string, and transporting the explosive tool over a public road away from the field location. In another embodiment, the armed explosive tool is a perforation gun. In another embodiment, the perforation gun is a downhole oil field tool. In an embodiment, the detonator is electrically activated.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIGS. 2*a* and 2*a*1 are illustrations of a safed state of a safety system of the explosive tool according to an embodiment of the disclosure.

FIGS. 2*b* and 2*b*1 are illustrations of an unsafed state of a safety system of the explosive tool according to an embodiment of the disclosure.

FIGS. 3*a* and 3*a*1 are illustrations of a safed state of a safety system of the explosive tool according to another embodiment of the disclosure.

FIGS. 3*b* and 3*b*1 are illustrations of an unsafed state of a safety system of the explosive tool according to another embodiment of the disclosure.

FIGS. 4*a* and 4*a*1 are illustrations of a safed state of a safety system of the explosive tool according to yet another embodiment of the disclosure.

FIGS. 4*b* and 4*b*1 are illustrations of an unsafed state of a safety system of the explosive tool according to yet another embodiment of the disclosure.

DETAILED DESCRIPTION

Figure 1:
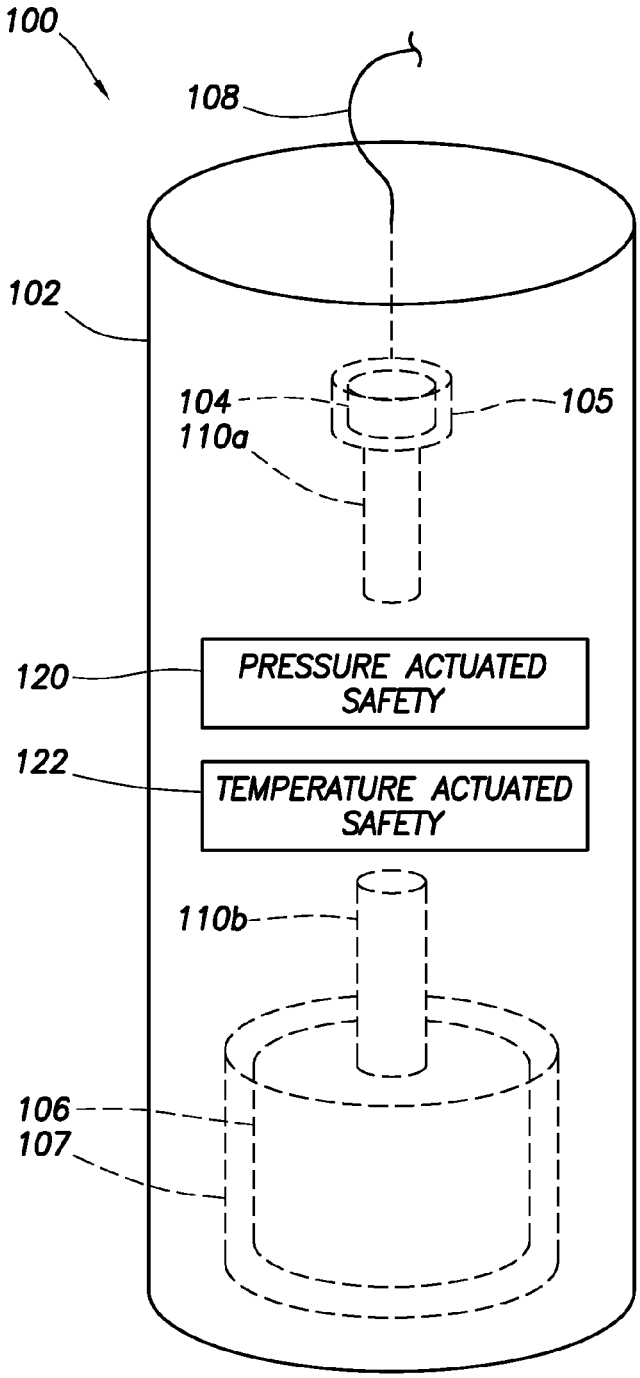
FIG. 1 is an illustration of an explosive tool according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Explosive tools may be used in a variety of construction and/or mining operations. A particular embodiment of an explosive tool is a perforation gun that may be used in well completion operations including water well completion, oil well completion, and/or gas well completion. In one embodiment, a perforation gun may be a downhole oilfield tool. While a perforation gun downhole oilfield tool will be discussed in detail hereinafter, one skilled in the art will appreciate that the advantages of the novel safety system and methods described with respect to a perforation gun may readily be applied to other explosive tools used in other construction and/or mining activities.

When fully assembled, a perforation gun may contain a detonator and an explosive charge that is powerful enough to effect the desired perforation of the well casing as well as creating channels in the formation surrounding the wellbore. A fully assembled perforation gun may also be referred to as armed and/or an armed perforation gun. In some embodiments, the explosive charge or charges may be shaped charges designed to focus their explosive energy in an effective direction, for example outwards. The detonator is directed to providing initiating energy to ignite the explosive charge. The detonator may be controlled by a variety of means including an electrical trigger or a mechanical trigger, for example a percussive device. Safety should be carefully provided for any fully assembled and/or armed perforation gun, because of the extreme energy and danger associated with accidental firing of the perforation gun at the surface. When the perforation gun has been run about 30 meters (about 100 feet), about 60 meters (about 200 feet), or about 90 meters (about 300 feet) into the wellbore, danger from the accidental firing of the perforation gun to personnel located at the surface may be assumed to be minimal. Various accidental perforation gun firing scenarios may be identified and safety mechanisms devised to mitigate the risk of the contemplated firing scenario accidentally firing the perforation gun.

The present disclosure contemplates the desirability of fully assembling a perforation gun at a central facility, for example a field office or a home office location, that may be staffed with more highly skilled personnel and that may be equipped with a clean workshop and precision tools necessary for the precise and perhaps delicate procedures of assembling a perforation gun. For example, a central workshop may have equipment needed to pressure test seals of the assembled perforation gun to assure that when the perforation gun is run into a wellbore, that fluid leaks will not occur that damage either the detonator, the charge, or other equipment within the perforation gun and interfere with the proper functioning of the perforation gun. To assure the safety of the perforation gun during transportation to the field location, during the connection of the perforation gun into a work string, and during the initial run-in of the perforation gun into the wellbore to a safe sub-surface depth, the present disclosure contemplates building the perforation gun with two distinct safety mechanisms, either of which is capable, operating alone, of preventing the ignition of the explosive charge and hence preventing accidental firing of the perforation gun. The safety mechanisms, in some contexts, may be referred to as safeties. A definition from a commonly used English dictionary provides a definition that substantially conforms to the intended use of this term herein: a safety may be a device, as on a weapon or a machine, designed to prevent inadvertent or hazardous operation. In particular, a first mechanically automated mechanical safety that is actuated in response to pressure incident on the perforation gun and a second mechanically automated mechanical safety that is actuated in response to temperature incident on the perforation gun are disclosed. The design of the safety system is such that at the surface neither the incident pressure or the incident temperature is great enough to actuate the safeties from a safed state to an unsafed state while it is expected that downhole both the incident pressure and the incident temperature will be great enough to actuate the safeties from the safed state to the unsafed state. Hence, the assembled and armed perforation gun on the surface is automatically in a safe state but when lowered into a wellbore to appropriate depths, the perforation gun automatically releases the safeties or transitions to the unsafed state. If the perforation gun needs to be removed from the wellbore unfired and/or undetonated, in many embodiments the safeties will actuate to return to the safed state as near surface pressures and temperatures are reached. In some circumstances, the perforation gun or other explosive tool may be transported over public roads and/or via airborne vehicles subject to governmental rules regarding transport of armed explosive devices.

Turning now to FIG. 1, a schematic view of a perforation gun explosive tool 100 is now discussed. The perforation gun 100 is configured to be attached to a work string, for example by coupling threadingly to the work string (threads not illustrated), and conveyed by the work string into a wellbore. At an appropriate depth and/or location in the wellbore, the perforation gun 100 is configured to be fired controllably from the surface to perforate an optional wellbore casing and to create channels a short distance into a formation surrounding the wellbore. Hydrocarbons and/or other fluids in the formation may migrate to the channels created in the formation, flow into the wellbore, rise to the surface through the wellbore and/or the optional wellbore casing, and be produced at the surface. In some circumstances, a plurality of perforation guns 100, for example ten perforation guns 100, may be coupled together for extending the perforation zone resulting from firing the stack or gang of perforation guns 100.

The perforation gun 100 comprises a body structure 102, a detonator 104, a charge 106, and a detonator trigger control 108. In some contexts, the body structure 102 may be referred to as the tool body. The detonator 104 may be installed into a first chamber 105 within the body structure 102, and the charge 106 may be installed into a second chamber 107 within the body structure 102. In an embodiment, the charge 106 may comprise a plurality of explosive components or sections. A port 110 provides communication between the first chamber 105 and the second chamber 107, for example via a first port segment 110*a* and a second port segment 110*b*. During normal downhole operations, when the detonator 104 is initiated, for example by an electrical signal or other control signal conveyed from the surface via the detonator trigger control 108, the detonator releases thermal energy that propagates through the first port segment 110*a*, jumps across a gap (not shown) to the second port segment 110*b*, propagates through the second port segment 110*b*, and ignites the charge 106. The ignited charge 106 explodes and perforates the optional wellbore casing and creates channels in the formation proximate to the wellbore. In some embodiments, a detonator chord or other fuse type of material may be installed into the first port segment 110*a* and/or into the second port segment 110*b*. In other embodiments, however, the first port segment 110*a* and the second port segment 110*b* are empty. In an embodiment, the thermal energy released by the detonator 104 is able to reliably ignite the charge 106 across a distance of about 7.5 cm (about three inches), for example 7.5 cm through the port 110. In some embodiments, the size and/or volume of the gap (not shown) may reduce the distance that the thermal energy released by the detonator 104 may traverse while reliably igniting the charge 106.

The perforation gun 100 further comprises a pressure actuated safety 120 and a temperature actuated safety 122. In some contexts, the pressure actuated safety 120 may be referred to as a pressure actuated interrupter and the temperature actuated safety 122 may be referred to as a temperature actuated interrupter. When in a safed state, the pressure actuated safety 120 deploys a first mechanical blocking member into the gap between the first port segment 110*a* and the second port segment 110*b* that prevents propagation of the thermal energy released by the detonator 104 from the first port segment 110*a* to the second port segment 110*b*, thereby preventing the ignition of the charge 106. Similarly, when in the safed state, the temperature actuated safety 122 deploys a second mechanical blocking member into the gap between the first port segment 110*a* and the second port segment 110*b* that prevents propagation of the thermal energy released by the detonator 104 from the first port segment 110*a* to the second port segment 110*b*, thereby preventing the ignition of the charge 106. It is not necessary that the safeties 120, 122 block all of the thermal energy but just to block sufficient thermal energy to prevent ignition of the charge 106. Either of the pressure actuated safety 120 and the temperature actuated safety 122, acting alone, is operable to block sufficient thermal energy to prevent the ignition of the charge 106. The pressure actuated safety 120 and the temperature actuated safety 122 may both be referred to as mechanically automated mechanical safeties and/or mechanically automated mechanical interrupters.

When in an unsafed state, the pressure actuated safety 120 moves the first mechanical blocking member out of or away from the gap between the first port segment 110*a* and the second port segment 110*b*. Similarly, when in the unsafed state, the temperature actuated safety 122 moves the second mechanical blocking member out of or away from the gap between the first port segment 110*a* and the second port segment 110*b*. When both the pressure actuated safety 120 and the temperature actuated safety 122 are in the unsafed state, the gap between the first port segment 110*a* and the second port segment 110*b* is unobstructed by either the first or the second mechanical blocking member, and when the thermal energy is released by the detonator 104, the thermal energy is able to propagate from the first port segment 110*a* across the gap to the second port segment 110*b* to ignite the charge 106. While in FIG. 1 the pressure actuated safety 120 is depicted as closer to the detonator 104 and the temperature actuated safety 122 is depicted as closer to the charge 106, in another embodiment, the locations of the safeties 104, 106 may be differently disposed, for example reversed in order.

The pressure actuated safety 120 is installed into the body structure 102 so that at least a portion of the pressure actuated safety 120 remains in communication with the exterior of the body structure 102, whereby the pressure actuated safety 120 may sample or respond to pressure incident upon the body structure 102 and/or upon the perforation gun 100. It is desirable that the pressure actuated safety 120 remain in a safed state when the pressure incident upon the perforation gun 100 is at about ambient surface pressure and while pressure increases as the perforation gun 100 is conveyed into a wellbore until the perforation gun 100 reaches a depth or displacement of about 30 meters (about 100 feet) into the wellbore, about 60 meters (about 200 feet) into the wellbore, about 90 meters (about 300 feet) into the wellbore, or some other effective safe distance into the wellbore. As the pressure incident upon the perforation gun 100 increases beyond a predefined pressure threshold, the pressure actuated safety 120, responsive to the increased pressure, transitions from the safed state to the unsafed state. In some contexts, the pressure actuated safety 120 may be said to be configured to prevent propagation of sufficient thermal energy between the detonator 104 and the charge 106 to ignite the charge when the pressure actuated safety 120 is at surface pressure and to not prevent propagation of sufficient thermal energy between the detonator 104 and the charge 106 to ignite the charge 106 when the pressure actuated safety 120 is at or above a predefined pressure threshold.

On withdrawal from the wellbore, assuming the charge 106 has not been fired, for example if some malfunction has prevented a trigger signal transmitted at the surface from causing the detonator to ignite, the pressure actuated safety 120, responsive to the decreased pressure as the perforation gun 100 is withdrawn from the wellbore, transitions from the unsafed state to the safed state. In some circumstances, the withdrawal of the perforation gun 100 may be paused at a depth of about 30 meters (about 100 feet) or about 60 meters (about 200 feet) or about 90 meters (about 300 feet) below or beyond the surface, to allow time for the pressure actuated safety 120 to respond to the decreased pressure and transition from the unsafed state to the safed state. The language 30 meters, 60 meters, and 90 meters beyond the surface is meant to indicate that the perforation gun 100 remains displaced the subject distance into the wellbore.

In different downhole environments, the pressure responsive element of the pressure actuated safety 120 may be selected to actuate at different predefined pressure thresholds. For example, the pressure actuated safety 120 having a specific predefined pressure threshold may be selected at a depot level maintenance site or other shop for installation into the perforation gun 100 based on a specific target field location and/or specific target regional location.

The temperature actuated safety 122 is installed into the body structure 102. In an embodiment, at least a portion of the temperature actuated safety 122 may remain in communication with the exterior of the body structure 102, whereby the temperature actuated safety 122 may more readily sample or respond to the temperature incident upon the exterior of the body structure 102 and/or upon the perforation gun 100. In another embodiment, however, the temperature actuated safety 122 may be enclosed within the body structure 102 and may respond to the temperature incident upon the exterior of the body structure 102 as the ambient temperature soaks through or conducts through the material of the body structure 102 to the temperature actuated safety 122. It is desirable that the temperature actuated safety 122 remain in the safed state when the temperature incident upon the perforation gun 100 is at about the ambient surface temperature and while the temperature changes as the perforation gun 100 is conveyed to a depth or displacement into the wellbore of about 30 meters (about 100 feet), about 60 meters (about 200 feet), about 90 meters (about 300 feet), or some other effective safe distance into the wellbore. In some contexts, the temperature actuated safety 122 may be said to be configured to prevent propagation of sufficient thermal energy between the detonator 104 and the charge 106 to ignite the charge when the temperature actuated safety 122 is at surface temperature and to not prevent propagation of sufficient thermal energy between the detonator 104 and the charge 106 to ignite the charge 106 when the temperature actuated safety 122 is at or above a predefined temperature threshold.

On withdrawal from the wellbore, assuming the charge 106 has not been fired, the temperature actuated safety 122, responsive to the change of ambient temperature as the perforation gun is withdrawn from the wellbore, transitions from the unsafed state to the safed state. In some circumstances, the withdrawal of the perforation gun 100 may be paused at a depth of about 60 meters (about 200 feet) or about 90 meters (about 300 feet) below or beyond the surface, to allow time for the temperature actuated safety 122 to respond to the changed temperature and transition from the unsafed state to the safed state. The language 30 meters, 60 meters, and 90 meters beyond the surface is meant to indicate that the perforation gun 100 remains displaced the subject distance into the wellbore.

In different downhole environments, the temperature responsive element of the temperature actuated safety 122 may be selected to actuate at different predefined temperature thresholds. For example, the temperature actuated safety 122 having a specific predefined temperature threshold may be selected at a depot level maintenance site or other shop for installation into the perforation gun 100 based on a specific target field location and/or specific target regional location. In some embodiments, the temperature responsive element of the temperature actuated safety 122 may be a wax thermostatic element. In other embodiments, the temperature responsive element of the temperature actuated safety 122 may be a bimetallic thermostatic element.

The perforation gun 100 combining the two safeties 120, 122 responsive to different parameters may provide increased handling safety through redundancy. The operation of the safeties 120, 122 to transition from unsafed back to safed may provide increased handling safety when it is necessary to withdraw an undetonated, unfired, and still armed perforation gun 100 out of the wellbore. Additionally, vehicle accident scenarios that may occur while transporting a fully assembled and armed perforation gun 100 over public roads and/or via airborne vehicles such as airplanes and/or helicopters to a field location can be effectively provided against by the combination of the pressure actuated safety 120 and the temperature actuated safety 122. An accident resulting in a fire may raise the temperature of the temperature actuated safety 122 sufficiently to cause the temperature actuated safety 122 to transition to the unsafed state. If only a temperature actuated safety 122 were employed, with no pressure actuated safety 120 installed, any chance electrostatic discharge might initiate the detonator 104, releasing thermal energy free to propagate through the first port segment 110*a* to the second port segment 110*b*, igniting the charge 106. The mechanical nature of the functioning of the safeties 120, 122—the mechanical interruption or blockage of the port 110 by the safeties 120, 122—provide desirable safety when using electrically initiated detonators with respect to electrical only safeties, from the point of view that even with an electrical path interrupted by an electrical safety, a stray electrostatic discharge may ignite the detonator.

In many cases it may be preferred to assemble the detonator 104 and the charge 106 into the perforation gun 100 at a central and/or regional office or shop where skilled personnel, trained personnel, and/or specialists may work in a controlled clean environment with precision tools. The combination of the pressure actuated safety 120 and the temperature actuated safety 122 may provide sufficient margin of safety to promote assembly of the detonator 104 and the charge 106 into the perforation gun 100 in a central or regional facility and transportation of the armed perforation gun 100 over the public roads, which may increase reliability of the perforation gun 100 and increase operational efficiency.

Turning to FIGS. 2*a*, 2*a*1 and FIGS. 2*b*, 2*b*1, embodiments of the pressure actuated safety 120 and the temperature actuated safety 122 are now discussed. In the embodiment illustrated in FIGS. 2*a*, 2*a*1 and FIGS. 2*b*, 2*b*1, the pressure actuated safety 120 comprises a retractable shaft that is spring loaded to extend, blocking the path between the first port segment 110*a* and the second port segment 110*b*, when the incident pressure is below the predefined pressure threshold. When the incident pressure is at or above the predefined pressure threshold, the incident pressure overcomes the spring loading to force the retractable shaft to retract from the path between the first port segment 110*a* and the second port segment 110*b*. In an embodiment, the retractable shaft of the pressure actuated safety 120 may have a hole there through that, when retracted under pressure, aligns with the first port segment 110*a* and/or the second port segment 110*b*. In an embodiment, the first port segment 110*a* and/or the second port segment 110*b* may be about 0.64 cm (0.25 inch) in diameter and the hole through the retractable shaft of the pressure actuated safety 120 may be about 0.95 cm (0.375 inch) in diameter. In other embodiments, the port segments 110*a*, 110*b* may have diameters different than about 0.64 cm (0.25 inch) and the hole through the retractable shaft of the pressure actuated safety 120 may have a diameter different than about 0.95 cm (0.375 inch). In another embodiment, however, the retractable shaft of the pressure actuated safety 120 may have no hole and when retracted under pressure may withdraw substantially from the path between the first port segment 110*a* and/or the second port segment 110*b*.

In the embodiment illustrated in FIGS. 2*a*, 2*a*1 and FIGS. 2*b*, 2*b*1, the temperature actuated safety 122 comprises a rotatable sleeve having a hole there through that is spring loaded to rotate in a first direction, unaligning the hole in the sleeve with the path between the first port segment 110*a* and the second port segment 110*b*, blocking the path between the first port segment 110*a* and the second port segment 110*b*, when the temperature is below a predefined temperature threshold. In an embodiment, the first port segment 110*a* and/or the second port segment 110*b* may be about 0.64 cm (0.25 inch) in diameter and the hole through the rotatable shaft of the temperature actuated safety 122 may be about 0.95 cm (0.375 inch) in diameter. In other embodiments, the port segments 110*a*, 110*b* may have diameters different than about 0.64 cm (0.25 inch) and the hole through the rotatable shaft of the temperature actuated safety 122 may have a diameter different than about 0.95 cm (0.375 inch). In an embodiment, the retractable shaft of the pressure actuated safety 120 is positioned within the rotatable sleeve of the temperature actuated safety 122. This configuration may reduce the size of the gap between the first port segment 110*a* and the second port segment 110*b*, increasing the reliability of ignition of the charge 106. When the incident temperature is at or above the predefined temperature threshold, a temperature responsive element of the temperature actuated safety 122 overcomes the spring loading to rotate the rotatable sleeve in a direction opposite the first direction, aligning the hole in the sleeve with the path between the first port segment 110*a* and the second port segment 110*b*, unblocking the path between the first port segment 110*a* and the second port segment 110*b*. In an embodiment, the temperature responsive element of the temperature actuated safety 122 may be a wax thermostatic element. In another embodiment, the temperature responsive element of the temperature actuated safety 122 may be a bimetallic thermostatic element. In an embodiment, the temperature actuated safety 122 may be keyed to encourage proper installation to provide the needed unalignment of the hole in the rotatable sleeve with the first port segment 110*a* and the second port segment 110*b* when safed and the needed alignment of the hole in the rotatable sleeve with the first port segment 110*a* and the second port segment 110*b* when unsafed. In some contexts, this may be referred to as impeding inoperable alignment. In an embodiment, the rotatable sleeve may be stopped at one or both ends of rotational movement by mechanical stops. In an embodiment, the pressure actuated safety 120 and the temperature actuated safety may be provided as an integrated package that installs from one side of the perforation gun 100.

FIGS. 2*a*, 2*a*1 illustrate an embodiment of both the pressure actuated safety 120 and the temperature actuated safety 122 in safed state. FIGS. 2*b*, 2*b*1 illustrate an embodiment of both the pressure actuated safety 120 and the temperature actuated safety 122 in unsafed state. In an embodiment, an exterior portion of the pressure actuated safety 120 may have a first tapped hole that permits installing a screw and/or bolt to force and hold the retractable shaft of the pressure actuated safety 120 in a safed condition as the screw and/or bolt is screwed into the first tapped hole. In an embodiment, the retractable shaft of the pressure actuated safety 120 may have a tapped hole such that a screw and/or bolt inserted through an exterior portion of the pressure actuated safety 120 may engage the tapped hole and retract the retractable shaft of the pressure actuated safety 120 and hold the retractable shaft in an unsafed condition.

Turning to FIGS. 3*a*, 3*a*1 and FIGS. 3*b*, 3*b*1, additional embodiments of the pressure actuated safety 120 and the temperature actuated safety 122 are now discussed. The pressure actuated safety 120 is substantially similar to the pressure actuated safety 120 described with respect to FIGS. 2*a*, 2*a*1 and FIGS. 2*b*, 2*b*1. In FIGS. 3*a*, 3*a*1 and FIGS. 3*b*, 3*b*1, the temperature actuated safety 122 comprises a retractable shaft that is spring loaded to extend, blocking the path between the first port segment 110*a* and the second port segment 110*b*, when the incident temperature is below the threshold. When the incident temperature is above the threshold, the incident temperature causes the temperature responsive element of the temperature actuated safety to overcome the spring loading to force the retractable shaft to retract from the path between the first port segment 110*a* and the second port segment 110*b*. In an embodiment, one or both of the retractable shafts of the safeties 120, 122 may have holes there through that align with the port segments 110*a*, 110*b* when the associated safeties 120, 122 are in the unsafe state. FIGS. 3*a*, 3*a*1 illustrate an embodiment of both the pressure actuated safety 120 and the temperature actuated safety 122 in safed state. FIGS. 3*b*, 3*b*1 illustrate an embodiment of both the pressure actuated safety 120 and the temperature actuated safety 122 in unsafed state.

Turning now to FIGS. 4*a*, 4*a*1 and FIGS. 4*b*, 4*b*1, additional embodiments of the pressure actuated safety 120 and the temperature actuated safety 122 are now discussed. The pressure actuated safety 120 comprises a rotatable shaft coupled transversely to a first substantially planar member having a hole there through. When the incident pressure is below the predefined pressure threshold, the rotatable shaft is spring loaded to a first position where the hole through the first planar member is unaligned with the path between the first port segment 110*a* and the second port segment 110*b*. When the incident pressure is at or above the predefined pressure threshold, a pressure responsive element of the pressure actuated safety 120 rotates the first planar member in a direction opposite the first direction and aligns the hole through the first planar member with the path between the first port segment 110*a* and the second port segment 110*b*. In an embodiment, the pressure actuated safety 120 may be keyed to encourage proper installation to provide the needed unalignment of the hole in the first planar member with the first port segment 110*a* and the second port segment 110*b* when safed and the needed alignment of the hole in the first planar member with the first port segment 110*a* and the second port segment 110*b* when unsafed. In an embodiment, the first planar member may be stopped at one or both ends of movement by mechanical stops.

The temperature actuated safety 122 comprises a rotatable shaft coupled transversely to a second substantially planar member having a hole there through. When the temperature is below the predefined temperature threshold, the rotatable shaft is spring loaded to rotate in a first direction to a position where the hole through the second planar member is unaligned with the path between the first port segment 110*a* and the second port segment 110*b*. When the temperature is at or above the predefined temperature threshold, a temperature responsive element of the temperature actuated safety 122 rotates the second planar member in a direction opposite the first direction and aligns the hole through the second planar member with the path between the first port segment 110*a* and the second port segment 110*b*. In an embodiment, the temperature actuated safety 122 may be keyed to encourage proper installation to provide the needed unalignment of the hole in the second planar member with the first port segment 110*a* and the second port segment 110*b* when safed and the needed alignment of the hole in the second planar member with the first port segment 110*a* and the second port segment 110*b* when unsafed. In an embodiment, the second planar member may be stopped at one or both ends of movement by mechanical stops.

FIGS. 4*a*, 4*a*1 illustrate an embodiment of both the pressure actuated safety 120 and the temperature actuated safety 122 in safed state. FIGS. 4*b*, 4*b*1 illustrate an embodiment of both the pressure actuated safety 120 and the temperature actuated safety 122 in unsafed state.

In some embodiments, a safety pin or safety rod (not shown) may be installed into the perforation gun 100. The safety rod is designed to block sufficient thermal energy released by the detonator 104 from propagating to ignite the charge 106. The safety rod may be inserted at any point along the port 110. The safety rod may be secured in place with a threaded head that couples threadingly to a tapped hole that is countersunk into the body structure 102. The safety rod may be used in combination with the mechanical automated mechanical safeties, for example the pressure actuated safety 120 and the temperature actuated safety 122, to provide an additional level of security and safety. The safety rod may be installed before transportation and removed at a field location without tampering with the pressure actuated safety 120 and/or the temperature actuated safety 122.

Figure 5:
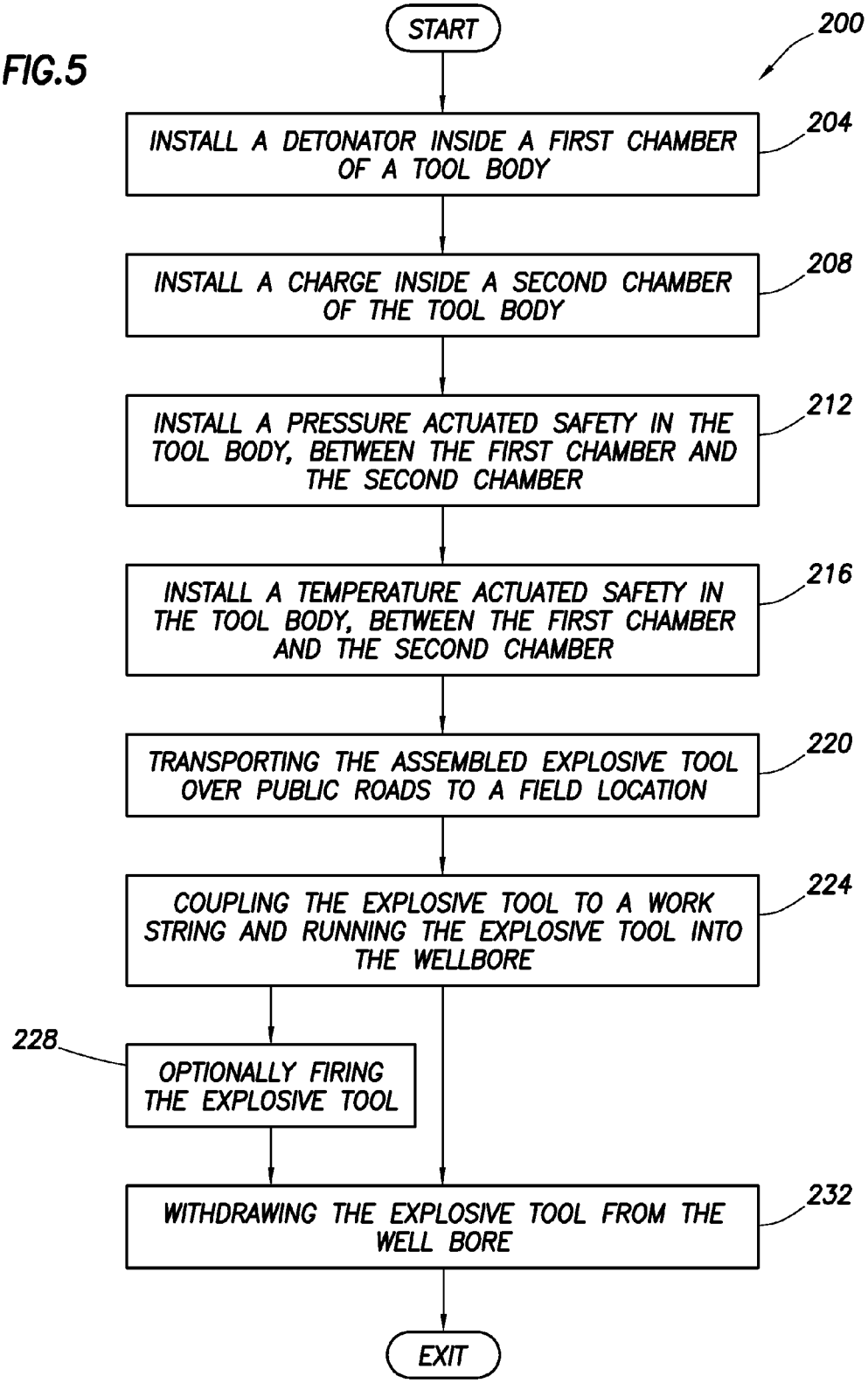
FIG. 5 is a flow chart of a method according to an embodiment of the disclosure.

Turning to FIG. 5, a method 200 is now discussed. At block 204, the detonator 104 is installed in a first chamber 105 of the body structure 102 or tool body. At block 208, the charge 106 is installed in a second chamber 107 of the body structure 102. At block 212, the pressure actuated safety 120 is installed into the body structure 102 between the first chamber 105 and the second chamber 107, for example between the first port section 110*a* and the second port section 110*b*. At block 216, the temperature actuated safety 122 is installed into the body structure 102 between the first chamber 105 and the second chamber 107, for example between the first port section 110*a* and the second port section 110*b*. In some embodiments, the pressure actuated safety 120 and/or the temperature actuated safety 122 may be keyed to impede installation in an improper alignment. In an embodiment, the installation of the detonator 104, the charge 106, the pressure actuated safety 120, and/or the temperature actuated safety 122 may be a complicated and/or precision procedure that may not be amenable to field installation. For example, O-ring seals or other seals may be installed with tight tolerances and may be subject to leaking under high downhole pressures and temperatures if not properly installed, if stressed during installation, or if dirt gets introduced into the contact area between the seals and the body structure 102. In an embodiment, proper sealing may be tested using pressure testing equipment.

After completing the blocks 204, 208, 212, and 216, the perforation gun 100 may be considered to be assembled and/or armed. In some circumstances, the blocks 204, 208, 212, and 216 may be performed before transporting the assembled perforation gun 100 over public roads and/or via airborne vehicles, for example via airplane and/or helicopters. The installation of the two safeties 120, 122 makes the perforation gun 100 safe for transport on public roads and/or handling in public places.

At block 220, the assembled perforation gun 100 is transported to a field location. At block 224, the perforation gun 100 is coupled to a work string, for example by threadingly coupling the perforation gun 100 to the work string, and the perforation gun 100 is run into the wellbore. At block 228, the perforation gun 100 is optionally fired. In some circumstances, however, the perforation gun 100 may not fire, for example in the case of some malfunction. At block 232, the perforation gun 100 is withdrawn from the wellbore. In some circumstances, the perforation gun 100 may be withdrawn to a depth of about 30 meters (about 100 feet) or to a depth of about 60 meters (about 200 feet) or to a depth of about 90 meters (about 300 feet) or to some other effective depth, and the withdrawal of the perforation gun 100 may then be halted for a predefined time interval, waiting to allow the pressure actuated safety 120 and the temperature actuated safety 122 to transition from the unsafed state to the safed state. For example, in an embodiment, the temperature incident upon the outside of the body structure 102 may take some time to conduct through the material of the body structure 102 to the enclosed temperature actuated safety 122 and cause the temperature actuated safety 122 to transition from the unsafed to the safed state. The withdrawal of the perforation gun 100 may then be completed after the passing of the time interval, and the perforation gun 100 may be decoupled from the work string. After decoupling from the work string, the perforation gun 100 may be transported away from the field location over public roads and/or via airborne vehicles.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An explosive tool, comprising:

a body structure;

a detonator disposed within a first chamber within the body structure;

a charge disposed within a second chamber within the body structure;

a port configured to provide communication between the first chamber and the second chamber;

a pressure actuated safety configured to block the communication through the port in response to a pressure below a predetermined pressure threshold and allow the communication through the port in response to a pressure at or above the predetermined pressure threshold; and a temperature actuated safety configured to block the communication through the port in response to a temperature below a predetermined temperature threshold and allow the communication through the port in response to a temperature at or above the predetermined temperature threshold, wherein at least a portion of the pressure actuated safety is positioned within a portion of the temperature actuated safety when the pressure actuated safety is configured to block communication through the port and when the temperature actuated safety is configured to block communication through the port.

2. The explosive tool of claim 1, wherein the pressure actuated safety comprises a retractable shaft that is spring loaded to extend to prevent propagation of sufficient thermal energy to ignite the charge when the pressure actuated safety is subjected to a pressure that is less than the predefined pressure threshold, and to retract to not prevent propagation of sufficient thermal energy to ignite the charge when the pressure actuated safety is subjected to at least the predefined pressure threshold.

3. The explosive tool of claim 2, wherein the temperature actuated safety comprises a rotatable sleeve, and wherein the retractable shaft of the pressure actuated safety is positioned within the rotatable sleeve of the temperature actuated safety at least when the retractable shaft is extended.

4. The explosive tool of claim 2, wherein the retractable shaft comprising a hole therethrough, wherein the retractable shaft is spring loaded to retract and align the hole with the port when the pressure actuated safety is subjected to at least the predefined pressure threshold, and to extend and not align the hole with the port when the pressure actuated safety is subjected to a pressure that is less than the predefined pressure threshold.

5. The explosive tool of claim 2, wherein the pressure actuated safety comprises a tapped hole configured to accept a device to hold the retractable shaft in an extended position and prevent propagation of sufficient thermal energy to ignite the charge.

6. The explosive tool of claim 1, wherein the temperature actuated safety comprises a rotatable sleeve that is spring loaded to rotate in a first direction to prevent propagation of sufficient thermal energy to ignite the charge when the temperature actuated safety is subjected to a temperature that is less than the predefined temperature threshold, and to rotate in a direction opposite the first direction to not prevent propagation of sufficient thermal energy to ignite the charge when the temperature actuated safety is subjected to at least the predefined temperature threshold.

7. The explosive tool of claim 6, wherein the rotatable sleeve comprises a hole disposed therethrough, wherein the rotatable sleeve is configured to align the hole with the port when the temperature actuated safety is subjected to at least the predefined temperature threshold, and wherein the rotatable sleeve is configured to not align the hole with the port when the when the temperature actuated safety is subjected to a temperature that is less than the predefined temperature threshold.

8. The explosive tool of claim 6, wherein the temperature actuated safety comprises a wax thermostatic element that actuates the rotary movement of the temperature actuated safety in response to temperature.

9. The explosive tool of claim 6, wherein the temperature actuated safety comprises a bimetallic thermostatic element that actuates the rotary movement of the temperature actuated safety in response to temperature.

10. The explosive tool of claim 6, further comprising a mechanical stop, wherein the mechanical stop is configured to stop the rotation of the rotatable sleeve in a position preventing propagation of sufficient thermal energy to ignite the charge or not preventing propagation of sufficient thermal energy to ignite the charge.

11. The explosive tool of claim 1, wherein the pressure actuated safety and the temperature actuated safety form an integrated package.

12. The explosive tool of claim 11, wherein the integrated package is configured to be installed within the body structure from a single side.

13. A method of detonating a charge in an explosive tool, the method comprising:

disposing an explosive tool within a wellbore, wherein the explosive tool comprises:

a pressure actuated safety blocking communication through a port, and a temperature actuated safety blocking the communication through the port, wherein at least a portion of one of the pressure actuated safety or the temperature actuated safety is positioned within the other component within the port;

exposing the temperature actuated safety to a temperature above a predetermined temperature threshold;

exposing the pressure actuated safety to a pressure above a predetermined pressure threshold;

unblocking the communication through the port in response to exposing the temperature actuated safety to the temperature above the predetermined temperature threshold and exposing the pressure actuated safety to the pressure above the predetermined pressure threshold;

detonating a detonator in a first chamber in fluid communication with the port;

propagating energy from the first chamber through the unblocked port; and detonating a charge in a second chamber in fluid communication with the first chamber through the port in response to propagating the energy through the port.

14. The method of claim 13, wherein the pressure actuated safety comprises a retractable shaft, and wherein unblocking the communication through the port comprises retracting the retractable shaft in response to exposing the pressure actuated safety to the pressure above the predetermined pressure threshold, and providing the communication through the port in response to retracting the retractable shaft.

15. The method of claim 14, wherein the retractable shaft comprises a hole disposed therethrough, and wherein unblocking the communication through the port further comprises, aligning the hole with the port in response to retracting the retractable shaft.

16. The method of claim 14, wherein retracting the retractable shaft comprises retracting the retractable shaft from within a portion of the temperature actuated safety.

17. The method of claim 13, wherein the temperature actuated safety comprises a rotatable sleeve, and wherein unblocking the communication through the port comprises rotating the rotatable sleeve in response to exposing the temperature actuated safety to the temperature above the predetermined temperature threshold, and providing the communication through the port in response to rotating the rotatable sleeve.

18. The method of claim 17, wherein the rotatable sleeve comprises a hole disposed therethrough, and wherein unblocking the communication through the port further comprises, rotating the hole in the rotatable sleeve into alignment with the port.

19. The method of claim 13, wherein the temperature actuated safety comprises at least one of a wax thermostatic element or a bimetallic thermostatic element.

20. The method of claim 13, wherein the pressure actuated safety and the temperature actuated safety comprise an integrated package.

* * * * *